US006155172A

United States Patent [19]

Nakajima

[11] Patent Number: 6,155,172

[45] Date of Patent: Dec. 5, 2000

[54] METHOD FOR SETTING PARAMETERS FOR BLASTING USING BAR-LIKE CHARGE

[76] Inventor: Yasuji Nakajima, 7-19, Morinosato 4-chome, Atsugi, Japan, 243-01

[21] Appl. No.: 09/203,973

[22] Filed: Dec. 2, 1998

[30] Foreign Application Priority Data

Dec. 16, 1997 [JP] Japan ..... 9-363516

[51] Int. Cl.[7] ..... F42B 3/00

[52] U.S. Cl. ..... 102/301; 102/302; 102/312

[58] Field of Search ..... 102/301, 302, 102/312

[56] References Cited

U.S. PATENT DOCUMENTS

| | | | |
|---|---|---|---|
| 3,735,704 | 5/1973 | Livingston | 102/301 |
| 5,375,527 | 12/1994 | Nakajima | 102/301 |
| 5,634,691 | 6/1997 | Kim et al. | 102/312 X |
| 5,650,588 | 7/1997 | Nakajima | 102/301 |

FOREIGN PATENT DOCUMENTS

| | | | |
|---|---|---|---|
| 405240600 | 9/1993 | Japan | 102/301 |
| 406201300 | 7/1994 | Japan | 102/301 |
| 9-113200 | 5/1997 | Japan | F42D 1/00 |
| 2662691 | 6/1997 | Japan | F42D 1/00 |

OTHER PUBLICATIONS

R. Gusteferson: "New Blasting Techology" Morikita Shuppan K.K., Apr. 10, 1981, pp. 60.

Ground Emission Division of Ministry of International Trade and Industry of Japan, "Explosive Safety Text Series 17", Jan., 1991, pp. 24, 25 and 46.

*Primary Examiner*—Peter A. Nelson

*Attorney, Agent, or Firm*—Trexler, Bushnell, Giangiori & Blackstone, Ltd.

[57] ABSTRACT

The present invention provides a method for setting parameters required for any type of blasting operation using a bar-like charge system by devising equations based on which the maximum blasting efficiency may be achieved within a safe range to prevent flying rock accidents even when the line of least resistance W or filler length P is unknown. When defining a blast hole diameter, i.e., charge diameter as d, a charge hole length as M, a filler length as P, a charge length N=M−P, a fracture radius or interval length as D, and the specific gravity of charge as A, if the charge hole angle with respect to the first free surface G1, is $\alpha \leqq 90°$, based on an equation for setting blasting coefficient c:

$$c = \frac{L}{V} = \frac{\pi d^2 (M-P) A}{4P^2 M \sin^3 \alpha} = 0.0002 \text{ to } 0.0005$$

and by removing the filler length P therefrom, a fracture rock volume V may be determined as:

$$V = \frac{\left\{ -\frac{\pi}{4} d^2 A + \sqrt{\left(\frac{\pi}{4} d^2 A\right)^2 + \pi d^2 A c M \sin^3 \alpha} \right\}^2}{4c^2 M \sin^3 \alpha}$$

and a charge amount L may also be determined as:

$$L = cV = \frac{\left\{ -\frac{\pi}{4} d^2 A + \sqrt{\left(\frac{\pi}{4} d^2 A\right)^2 + \pi d^2 A c M \sin^3 \alpha} \right\}^2}{4cM \sin^3 \alpha}.$$

20 Claims, 2 Drawing Sheets

METHOD FOR SETTING PARAMETERS FOR BLASTING USING BAR-LIKE CHARGE

BACKGROUND

The present invention relates in general to a method for setting parameters required for blasting utilizing bar-like charge, more specifically to a method for setting parameters required for blasting with a bar-like charge system having a drilled blast hole diameter d, which is indispensable to the bar-like charge, associated mutually with other parameters such as a blast hole length M, a filler length P, a charge length N=M−P, charge specific gravity A, a fracture rock volume V, a blasting coefficient c, etc., employing basic equations capable of being applied to blasting for one and two free surface(s), as well as to blasting with a blast hole angle of $\alpha=90°$, and $\alpha<90°$.

Chemical explosives capable of causing explosions associated with heating and burning were invented in China in ancient times in the era Tang (618–907). Alfred Novel developed "Dynamite" made primarily of nitroglycerine, in the spring of 1864, obtained a Swedish patent. Since then, it is well known that explosives have been necessitated in modern wars as weapons of cutting edge technology, while on the other hand, they have also been used for destruction in land cultivation on a commercial basis. The principle of the explosion and the relationship between the destructive range and amount of explosives have been kept secret under the control of various governments.

Conventionally, land cultivation has been normally performed on undeveloped wilderness, and has not caused serious problems by merely considering the efficiency of blasting. Such blasting may be performed without paying attention to the avoidance of accidents associated with blasting, such as damage by flying rocks, thanks to the tolerance of nature.

However, in recent years, when performing blasting for construction in a small well-developed area, for example in such a country as Japan, or in an area close to human residences, it is of urgent importance to direct blasting, with dangerous explosives which may destroy anything, as technology clearly distinguishing safety and danger, by means of human wisdom, as was done with the "quest of fire" in early human history.

For assuring security which avoids flying rock accidents, importance is given to reducing the amount of explosive. However, when the amount of explosive is reduced excessively, the efficiency of blasting is inherently lowered to an unacceptable degree. Accordingly, it is desired to use the maximum amount of explosive in a range where flying rock will not be caused on the free surface, thus achieving both the security and efficiency of blasting operations.

Under such circumstances, as a method for setting blasting in consideration of both security and efficiency, Hauser's equation has been used. Hauser's equation is directed to a concentrated charge at a single point, and establishes the following equation for achieving both security and efficiency:

$$L=cW^3 \tag{20}$$

wherein c is a blasting coefficient in the range of 0.25 to 0.45 and W is the least resistant length between the explosive and the free surface of the earth.

Studying Hauser's equation, assuming that the breaking radius D on the free surface is equal to the least resistant length W (i.e., when W=D), the volume of the rock to be broken by the explosive is in a reversed cone-shaped configuration, from a volume of cone, the volume V of the rock to be broken into the reversed cone-shaped configuration is expressed by:

$$V=W^3$$

Accordingly, the foregoing equation (20) can be modified to:

$$L=cV \tag{20a}$$

The relational expression L=c×V indicates that, in order to make the value of L within the safe range, the charge amount L should be a value within a blasting coefficient range of c=0.25 to 0.45 of the fracture volume V of the rock to be fractured at that charge amount.

In blasting operations using a bar-like charge, in practice, a modified Hauser's equation $L=cW^3$ is employed. Namely, by replacing $W^3$ with DWH, Hauser's equation can be rewritten as:

$$L=cDWH \tag{20b}$$

wherein c: blasting coefficient;

D: fracture radius in the free surface;

W: line of least resistance; and

H: is a charge hole length.

However, in practical blasting operations, the bar-like charge system is used to charge an explosive within a pit or hole having a certain length H and diameter d. Therefore, the explosive is present as a solid having a certain length (charge length N=H−W) and diameter d, wherein W is the line of least resistance.

Accordingly, when a charge amount L required for blasting using the bar-like charging is derived employing the Hauser's equation, a value far different from the practical amount may be derived to cause significant danger. For example, when blasting of a rock is to be performed employing dynamite stick having a diameter of explosive of 25 mm charged in a hole diameter d=25 mm, the charge amount L derived by Hauser's equation becomes:

$$L=cW^3=0.25\times2^3=2\ (\text{kg})$$

assuming the blasting coefficient c=0.25 and the line of least resistance W=2 m. This charge amount corresponds to a twenty sticks of dynamite having explosive diameter of 25 mm, explosive length of 165 mm, and weight of 100 g. When such dynamite is charged in the 2 m of charge hole, the hole will be filled with 12.5 sticks of dynamite. Thus, the remaining 7.5 charges of dynamite cannot be placed in the charge hole. Therefore, in order to maintain the calculated charge amount, the diameter of the charging hole should be increased to 80 to 100, or more. However, the hole diameter d cannot be derived by using Hauser's equation.

In this respect, charge hole diameter d is typically empirically thought to be at 1/45 of the line of least resistance W (see R. Gusteferson: "New Blasting Technology", Morikita Shuppan K.K., Apr. 10, 1981, pp. 60). Also, the Japan Industrial Explosive Association utilizes similar standards but widens the allowable range and provides a guideline, "In case of typical blasting, the line of least resistance is within a range of from 30 to 60 times the charge hole diameter". In other words, "the charge hole diameter d is from 1/30 to 1/60 of the line of least resistance W" (see Ground Emission Division of Ministry of International Trade and Industry of Japan, "Explosive Safety Text Series 17", January, 1991, pp 24). In a concrete example of this relationship, when a charge hole diameter d is set at 3 cm, the line of least resistance W can be within a range of 90 to 180 cm. Such range is too wide in view of a critical line of least resistance length, and could possibly cause the occurrence of an accident to human beings, and thus is dangerous.

The inventor of the present invention thinks as follows; the reason is that the line of least resistance W in the blasting operation is a value representative of the shortest distance between the upper end of the explosive and the free surface of the earth. When the value of the line of least resistance W is too short, an accident due to flying rocks may be caused. On the other hand, when the value of the line of least resistance W is too long, fracturing at the surface of the earth may become insufficient and lower the efficiency of operation. Therefore, as can be appreciated from the foregoing, the line of least resistance W is believed to be quite an important factor in determining safety and efficiency in blasting operations.

However, the fact that ambiguous relationships between the hole diameter d and line of least resistance W can be set within a wide allowable range should be pointed out in view of both safety and efficiency.

The number of accidents by blasts during construction work in Japan from 1979 to 1989 totaled 261, in which accidents by flying rock accounted for 160 cases (61.3%). This shows that a need to establish a method to set bar-like charges that enable safe and efficient blasting operations.

In order to solve the above-mentioned problems, the inventor has developed a method for determining relational parameters, comprising the steps of, as indicated in Japanese Patent No. 2662691, deriving a charge amount L for a bar-like charge at the charge hole angle $\alpha=90°$ from the following, formula used to determine the volume of a cylinder:

$$L=\frac{\pi}{4}d^2(H-W)A \tag{2a}$$

where d is the blast hole diameter; H is the blast hole length; W is the line of least resistance; N=H−W is the charge length; c is the blasting coefficient; and A is the specific gravity of the explosive;

deriving, on the other hand, on the basis of the modified equation L=cDWH (20b) of Hauser's conventional equation $L=cW^3$, the safety charge amount L as:

$$L=cW^2H \tag{20c}$$

deriving a fundamental equation therefrom, since both members of the above relational expressions are equal:

$$cW^2H=\frac{\pi}{4}d^2(H-W)A \tag{21}$$

The inventor has also developed a method for determining the relational parameters, comprising the steps of, as indicated in U.S. Pat. No. 5,650,588 corresponding to Japanese Patent Laid-Open No. 9-113200, deriving a charge amount L for bar-like charges not only at the charge hole angle $\alpha=90°$ but also in case of $\alpha<90°$ based on the equation for determining the volume of a cylinder:

$$L=\frac{\pi}{4}d^2(M-P)A \tag{2}$$

where M is the blast hole length; P is the filler length;

deriving, on the other hand, from a modified Hauser's equation of the conventional $L=cW^3$, the charge amount L as:

$$L=cP^2M\sin^3\alpha \tag{20d}$$

and then deriving a fundamental equation since both members of the above relational expressions are equal:

$$cP^2M\sin^3\alpha=\frac{\pi}{4}d^2(M-P)A \tag{21a}$$

OBJECT AND SUMMARY

As stated above, the inventor of the present invention has developed a method for setting bar-like charges for blasting in which the charge hole diameter d is determined based on the relationship with the line of least resistance W in the case of hole angle $\alpha=90°$, or on the relationship with the filler length P in the case of hole angle $\alpha\leqq 90°$, to set other parameters required for blasting operation using a bar-like charge.

However, in the practice of blasting operations using a bar-like charge either the line of least resistance W or the filler length P is not always provided a priori. Rather, there are cases where setting is carried out with these parameters being unknown, and thus other parameters being known. Therefore there is a need to perform blasting safely and efficiently at all times.

An object of the present invention is to provide a method for setting parameters required for performing blasting using bar-like charges by devising fundamental equations that allow maximum explosion efficiency to be achieved in a range where flying rock will not be caused if the line of least resistance W or the filler length P is unknown, which has been thought to be required in the prior art for providing safety and efficiency at the time of blasting.

According to the present invention, in order to accomplish the above-mentioned object, in case of G1: a free surfase of the earth $\alpha\leqq 90°$: a blast hole angle relating to the free surface G1

M: a blast hole length

P: a filler length in the blast hole

N=M−P: a charge length

L: a charge amount

A: charge specific gravity c: blasting coefficient

D: a fracture radious or interval length

V: a fracture rock volume

W: the line of least resistance between the free surface G1 and the head of the charge length;

a method for blasting using a bar-like charge system comprises the steps of:

deriving a fracture rock volume V to be blasted:

$$V=P^2M\sin^3\alpha \tag{1}$$

deriving a charge amount L from an equation for deriving the volume of a cylinder:

$$L = \frac{\pi}{4} d^2 (M - P) A \tag{2}$$

deriving a fundamental equation for a blasting coefficient c which indicates the ratio of (1) to (2):

$$c = \frac{L}{V} = \frac{\pi d^2 (M - P) A}{4 P^2 M \sin^3 \alpha} \tag{3}$$

deriving a filler length P by converting equation (3) to the quadratic equation of the filler length P:

$$P = \frac{-\frac{\pi}{4} d^2 A + \sqrt{\left(\frac{\pi}{4} d^2 A\right)^2 + \pi d^2 A c M \sin^3 \alpha}}{2 c M \sin^3 \alpha} \tag{4}$$

then substituting $P^2$ obtained by squaring both members into equation (1) to derive the fracture rock volume V:

$$V = \frac{\left\{-\frac{\pi}{4} d^2 A + \sqrt{\left(\frac{\pi}{4} d^2 A\right)^2 + \pi d^2 A c M \sin^3 \alpha}\right\}^2}{4 c^2 M \sin^3 \alpha} \tag{5}$$

where the blasting coefficient c in the equation (5) should be within the range of:

c=0.0002–0.0005.

Furthermore, by substituting equation (5) into a modified equation (3), i.e., L=cV, to obtain the charge amount L by:

$$L = \frac{\left\{-\frac{\pi}{4} d^2 A + \sqrt{\left(\frac{\pi}{4} d^2 A\right)^2 + \pi d^2 A c M \sin^3 \alpha}\right\}^2}{4 c M \sin^3 \alpha} \tag{6}$$

where the blasting coefficient c should be within the range of:

c=0.0002–0.0005.

Also, from equation (2) and modified equation (3):

$$L = cV = \frac{\pi}{4} d^2 (M - P) A$$

the charge length N=M−P may be determined by:

$$N = \frac{4cV}{\pi d^2 A} \tag{7}$$

where the blasting coefficient c should be within the range of:

c=0.0002–0.0005.

Similarly, since the filler length P is P=M−N, by substituting equation (7) into this equation;

$$P = M - \frac{4cV}{\pi d^2 A} \tag{8}$$

is obtained, where the blasting coefficient c should be within the range of:

c=0.0002–0.0005.

When the fracture radius or interval length D is identical to the filler length P, i.e., P=E, then the fracture radius or interval length D may be obtained from the equation (8) by:

$$D = M - \frac{4cV}{\pi d^2 A} \tag{9}$$

where the blasting coefficient c should be within the range of:

c=0.0002–0.0005.

In the practice of blasting with a bar-like charge system for two free surfaces, when an interval length E between the drilled point and a second free surface G2 is set to be equal to the filler length P, i.e., E=P, then instead of using the equation set forth in claim 8, the interval length E is determined by:

$$E = M - \frac{4cV}{\pi d^2 A} \tag{10}$$

where the blasting coefficient c should be within the range of:

c=0.0002–0.0005.

By modifying equation (8) above, the charge hole length M is determined by:

$$M = P + \frac{4cV}{\pi d^2 A} \tag{11}$$

where the blasting coefficient c should be within a range of:

c=0.0002–0.0005.

In addition, since the line of least resistance W is W=P sin α when α≦90°, the line of least resistance W is determined by $$W = \left\{M - \frac{4cV}{\pi d^2 A}\right\} \sin\alpha \tag{14}$$

where the blasting coefficient c should be within the range of:

c=0.0002–0.0005.

If a fracture radius or interval length D is equal to the line of least resistance W, i.e., D=W, then the fracture radius or interval length D may be expressed, according to equation (14), as:

$$D = \left\{M - \frac{4cV}{\pi d^2 A}\right\} \sin\alpha \tag{15}$$

where the blasting coefficient c should be within the range of:

c=0.0002–0.0005.

In the practice of blasting with a bar-like charge system for two free surfaces, when the interval length E between the drilled charge point and the second free surface G2 is set to be equal to the line of least resistance W, i.e., E=W, since E=P sin α, the interval length E from equation (14) may be expressed as:

$$E = \left\{M - \frac{4cV}{\pi d^2 A}\right\} \sin\alpha \tag{16}$$

where the blasting coefficient c should be within the range of:

c=0.0002–0.0005.

Additionally, the filler length P may be expressed by modifying equation (1) as:

$$P = \sqrt{\frac{V}{M\sin^3\alpha}} \tag{17}$$

where the blasting coefficient c should be within a range of:

c=0.0002–0.0005.

If the fracture radius or interval length D is set to be equal to the filler length P, i.e., D=P, the fracture radius or interval length D may be expressed, instead of equation (17) set forth in claim 17, as:

$$D = \sqrt{\frac{V}{M\sin^3\alpha}} \tag{18}$$

where the blasting coefficient c should be within a range of:

c=0.0002–0.0005.

In the practice of blasting with a bar-like charge system for two free surfaces, when the interval length E between the drilled charge point and the second free surface G2 is set to be equal to the filler length P, i.e., E=P, then the interval length E may be expressed, instead of equation (17) above, as:

$$E = \sqrt{\frac{V}{M\sin^3\alpha}} \tag{19}$$

where the blasting coefficient c should be within the range of:

c=0.0002–0.0005.

The fracture rock volume V, as mentioned above, may be expressed by such equation for V as set forth in equation (1) or (5).

According to the present invention, as can be appreciated from the above paragraphs, although in the prior art the line of least resistance W as well as the filler length P against the charge hole diameter d were used as fundamental parameters for determining parameters required for blasting with a bar-like charge system, the inventor has successfully developed a method for estimating the safety and danger from the value of blasting coefficient c in context in which the line of least resistance W and the filler length P are unknown, by devising fourteen equations, from (5) to (19) except for (11), of all 15 equations derived by the present invention.

BRIEF DESCRIPTION OF THE DRAWINGS

The present invention will be understood more fully from the detailed description given hereinbelow and from the accompanying drawings of the preferred embodiment of the invention, which, however, should not be taken to limit the present invention, but are for explanation and understanding only.

In the drawings.

DESCRIPTION

The present invention will be discussed hereinafter in further detail with references to the accompanying drawings. In the following description, a number of specific details are set forth in order to provide a thorough understanding of the present invention. It will be obvious, however, to those skilled in the art that the present invention may be practiced without these specific details. In other instances, well-known structures are not shown in detail in order not to obscure the true spirit and scope of the present invention.

According to the present invention, said equation (1), i.e., $V=P^2M\sin^3\alpha$ is provided, at the early stage for removing the line of least resistance W and the filler length P, in the scale of blasting in which the fracture rock volume V constituting the denominator of the blasting coefficient c is allowable for blasting using a bar-like charge system for one free surface with a charge hole angle α≦90°. Modes for carrying out the present invention will be described in greater detail below.

Figure 1:
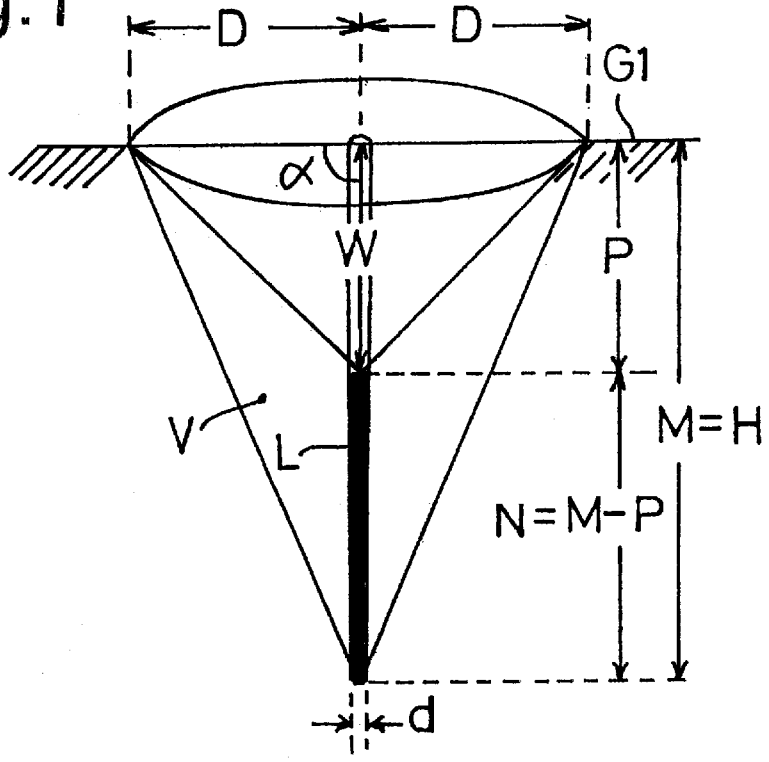
FIG. 1 is an explanatory schematic view showing the relationship of various portions, required for setting according to the present invention, in blasting using a bar-like charge with a charge hole angle α=90° in one free surface.

As shown in FIG. 1, in the blasting operation using a bar-like charge system for one free surface, when the α is 90°, the line of least resistance is W, the fracture radius or interval length is D, and $$W=D=P \tag{1a}$$

then the fracture rock volume V may be set by:

$$V=D\times D\times M \tag{1b}$$

since sin α=1, thus $$\sin^3\alpha=1 \tag{1c}$$

and by substituting equations (1a) and (1c) into equation (1b), $$V=P^2M\sin^3\alpha \tag{1}$$

may be obtained.

Figure 2:
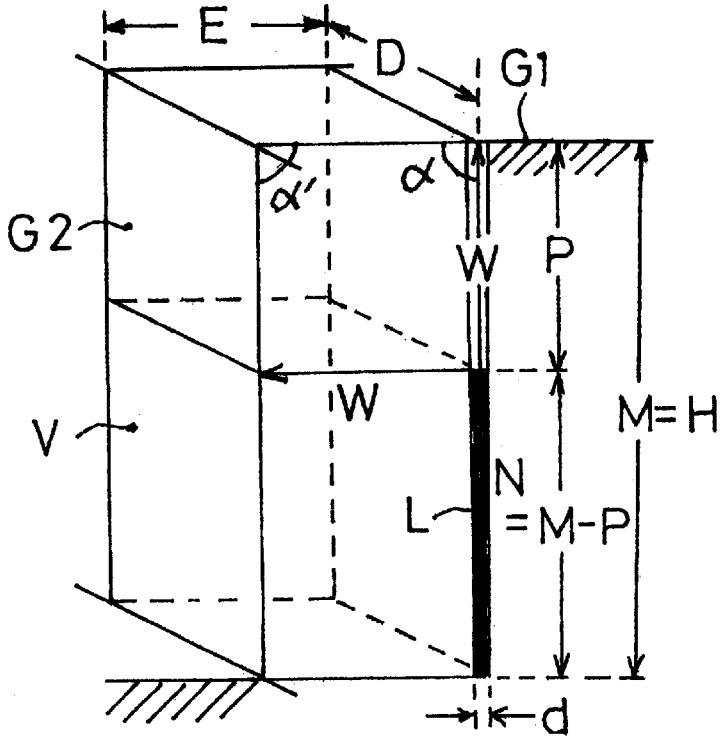
FIG. 2 is an explanatory schematic view showing the relationship of various portions, required for setting according to the present invention, in blasting using a bar-like charge with a charge hole angle α=90° in two free surfaces.

As shown in FIG. 2, in the blasting operation using a bar-like charge system for two free surfaces, when the angle α is 90°, the line of least resistance is W, the fracture radius or interval length is D, an interval length between the charge hole point and a second free surface G2 is E, and $$W=E=D=P \tag{1aa}$$

then the fracture rock volume V may be set by:

$$V=D\times E\times M \tag{1bb}$$

since sin α=1, thus:

$$\sin^3\alpha=1 \tag{1cc}$$

and by substituting equations (1aa) and (1cc) into equation (1bb), $$V=P^2M\sin^3\alpha \quad (1)$$

may be obtained.

Figure 3:
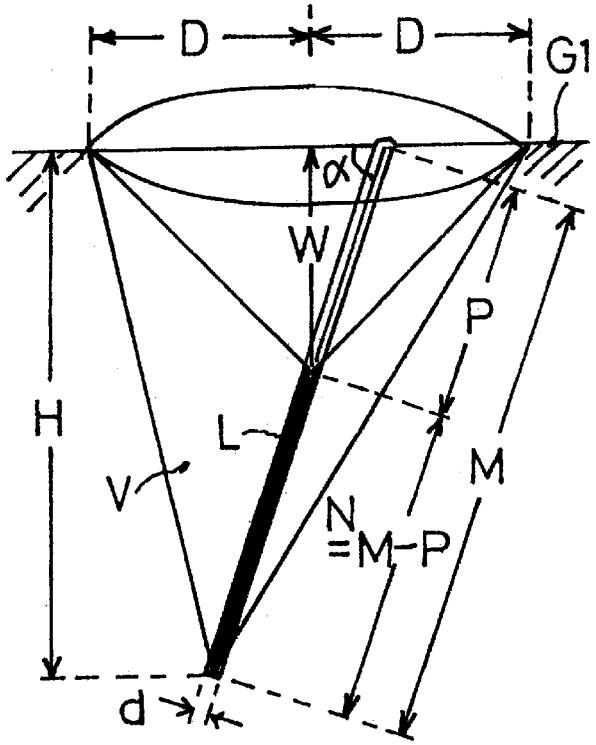
FIG. 3 is an explanatory schematic view showing the relationship of various portions, required for setting according to the present invention, in blasting using a bar-like charge with a charge hole angle α<90° in one free surface.

As shown in FIG. 3, in the blasting operation using a bar-like charge system for one free surface, when $\alpha<90°$, the line of least resistance is W, the fracture radius or interval length is D, and $$W=D<P \quad (1aaa)$$

then the fracture rock volume V may be set by:

$$V=D\times D\times H \quad (1bbb)$$

where H is the vertical height of the hole length M from the free surface G1, and H<M, thus:

$$H=M\sin\alpha \quad (1d)$$

and by substituting equations (1aaa) and (1d) into equation (1bbb), $$V=P\sin\alpha\times P\sin\alpha\times M\sin\alpha=P^2M\sin^3\alpha \quad (1)$$

may be obtained.

Figure 4:
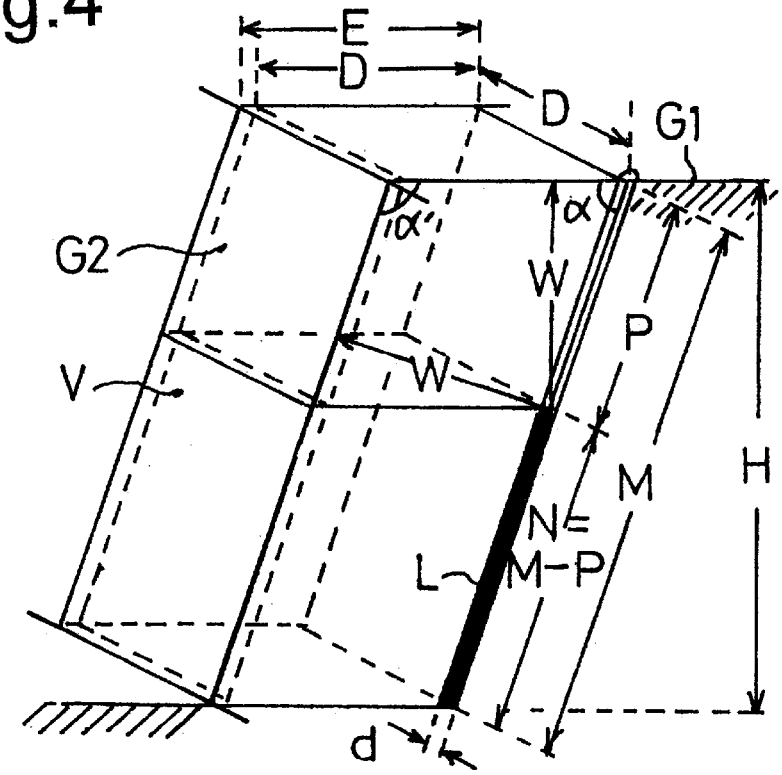
FIG. 4 is an explanatory schematic view showing the relationship of various portions, required for setting according to the present invention, in blasting using a bar-like charge with a charge hole angle α<90° in two free surfaces.

As shown in FIG. 4, in the blasting operation usging a bar-like charge system for two free surfaces, when $\alpha<90°$, the line of least resistance is W, the fracture radius or interval length is D, the interval length between the charge hole point and the second free surface G2 is E, and $$W=D<P=E \quad (1aaaa)$$

then the fracture rock volume V may be set by:

$$V=D\times E\times H \quad (1bbbb)$$

where H defines the vertical height of the hole length M from the free surface G1, and H<M, thus:

$$H=H\sin\alpha \quad (1d)$$

therefore, $$V=P\sin\alpha\times E\sin\alpha\times M\sin\alpha=P^2M\sin^3\alpha \quad (1)$$

may be obtained by substituting equations (1aaa) and (1d) into equation (1bbb).

Assuming that the following parameters are predetermined:

blast hole diameter i.e. charge diameter d=8.0 cm;

blast hole length M=372.5 cm;

specific gravity of the explosive A=1.0;

blasting coefficient c=0.00045; and a predetermined blast hole angle $\alpha=90°$, thus sin 90°=1.0;

therefore, in the cases as shown in FIGS. 1 and 2, the fracture rock volume V may be obtained by:

$$V=\frac{\left\{-\frac{\pi}{4}d^2A+\sqrt{\left(\frac{\pi}{4}d^2A\right)^2+\pi d^2AcM^2\sin^3\alpha}\right\}^2}{4cM\sin^3\alpha} \approx 17430000\,\text{cm}^3 \quad (5)$$

and the charge amount L may be obtained by:

$$L=cV=\frac{\left\{-\frac{\pi}{4}d^2A+\sqrt{\left(\frac{\pi}{4}d^2A\right)^2+\pi d^2AcM^2\sin^3\alpha}\right\}^2}{4cM\sin^3\alpha} = 0.00045\times 17430000 \approx 7843\text{g}. \quad (6)$$

In addition, the charge length N may be obtained by:

$$N=\frac{4cV}{\pi d^a A} \approx 156\,\text{cm}. \quad (7)$$

When $\alpha=90°$, since the filler length P equals the line of least resistance W, P and W may be obtained by:

$$P=W=M-\frac{4cV}{\pi d^2A} = 372.5-156 = 216.5\,\text{cm} \quad (8)$$

$$P=\sqrt{\frac{V}{M\sin^3\alpha}} \quad (17)$$

thus P=216.5 cm.

The fracture radius or interval length D is equal to the line of least resistance W and the filler length P, i.e., D=W=P; therefore, D=216.5 cm.

In the case of blasting two free surfaces (see FIG. 2), as the interval length E between the blasting point and the second free surface G2 is equal to the line of least resistance W, interval length D, and filler length P, i.e., E=W=P=D, thus the interval length E may be determined as:

E=216.5 cm from which the value for the blasting operation using a bar-like charge system may be set.

When the blast hole angle $\alpha$ is <90°, as shown in FIGS. 3 and 4, more specifically if $\alpha=70°$, the inclination angle of the two free surfaces G2 is $\alpha=70°$, sin 70°=0.9397

$\sin^3$ 70°=0.83 and the fracture rock volume V may be obtained by:

$$V=\frac{\left\{-\frac{\pi}{4}d^2A+\sqrt{\left(\frac{\pi}{4}d^2A\right)^2+\pi d^2AcM\sin^3\alpha}\right\}^2}{4c^2M\sin\alpha} \approx 16102650\,\text{cm}^3 \quad (5)$$

the charge amount L may be obtained by:

$$L=cV\approx 7246\text{ g}$$

the charge length N may be obtained by:

$$N = \frac{4cV}{\pi d^2 A} \approx 144\,\text{cm} \tag{7}$$

the filler length P may be obtained by:

$$P = M - \frac{4cV}{\pi d^2 A} \tag{8}$$

or $$P = \sqrt{\frac{V}{M\sin^3\alpha}} \approx 228.5\,\text{cm} \tag{17}$$

and the fracture radius or interval length D may be obtained by:

$$D = M - \frac{4cV}{\pi d^2 A} = 228.5\,\text{cm}. \tag{9}$$

In the case of blasting two free surface (see FIG. 4), since the interval length E between the charge point and the second free surface G2 is equal to the interval length D, i.e., E=D, the interval length E may be obtained by:

E=228.5 cm from which the value of the blasting operation using a bar-like charge system may be set.

As can be seen from the foregoing description, according to the present invention, even though the line of least resistance W or filler length P is unknown, which has been thought in the prior art to be essential for optimizing the safety and efficiency in any type of blasting operations of bar-like charge systems, including the blast hole angle $\alpha=90°$, $\alpha<90°$, a fundamental equation for setting blasting operations for one free surface and/or two free surfaces:

$$c = \frac{L}{V} = \frac{\pi d^2 (M-P)A}{4P^2 M\sin^3\alpha}$$

is established, which allows the maximum blasting efficiency to be achieved within a safe range in which no flying rock accidents will be caused. Such parameters as the fracture rock volume V, the charge amount L, and so forth may be successfully obtained therefrom, with the line of least resistance W or filler length P being omitted. Accurate parameter values essential to blasting using a bar-like charge system that relied on inaccurate and dangerous settings in the past may be obtained, satisfying both the safety and possible blasting efficiency requirements, even when the line of least resistance W or filler length P is unknown. According to the present invention, any type of blasting using a bar-like charge system may be performed in a safe and efficient manner.

What is claimed is:

1. A method for setting fracture rock volume to be blasted with bar-like charge system, comprising the steps of V:

deriving a fracture rock volume V:

$$V=P^2M\sin^3\alpha \tag{1}$$

at the charge hole angle $\alpha \leqq 90°$ based on a first free surface G1, where a charge hole diameter is defined as d, a charge hole length as M, a filler length as P, a charge length as N=M−P, a fracture radius or interval length as D, and an explosive specific gravity as A;

deriving the charge amount L from an equation for deriving the volume of a cylinder:

$$L = \frac{\pi}{4}d^2(M-P)A \tag{2}$$

deriving a fundamental equation for a blasting coefficient c which indicates the ratio of (1) to (2):

$$c = \frac{L}{V} = \frac{\pi d^2 (M-P)A}{4P^2 M\sin^3\alpha} \tag{3}$$

deriving the filler length P by converting equation (3) to the quadratic equation of the filler length P:

$$P = \frac{-\frac{\pi}{4}d^2A + \sqrt{\left(\frac{\pi}{4}d^2A\right)^2 + \pi d^2 AcM\sin^3\alpha}}{2cM\sin^3\alpha} \tag{4}$$

then substituting $P^2$ obtained by squaring both members into equation (1) to derive the fracture rock volume V:

$$V = \frac{\left\{-\frac{\pi}{4}d^2A + \sqrt{\left(\frac{\pi}{4}d^2A\right)^2 + \pi d^2 AcM\sin^3\alpha}\right\}^2}{4c^2M\sin^3\alpha} \tag{5}$$

where the blasting coefficient c in equation (5) should be within the range of c from 0.0002 to 0.0005.

2. A method for setting fracture rock volume to be blasted with a bar-like charge system according to claim 1, wherein in a blasting operation using a bar-like charge system for one free surface, when $\alpha=90°$, the line of least resistance is defined as W, the fracture radius or interval length as D, and $$W=D=P \tag{1a}$$

said fracture rock volume V being $$V=D\times D\times M \tag{1b}$$

since $\sin\alpha=1$, thus $$\sin^3\alpha=1 \tag{1c}$$

$$V=P^2M\sin^3\alpha \tag{1}$$

may be obtained by substituting (1a) and (1c) into (1b).

3. A method for setting fracture rock volume to be blasted with a bar-like charge system according to claim 1, wherein in a blasting operation using a bar-like charge system for two free surfaces, when $\alpha=90°$, a line of least resistance is defined as W, the fracture radius or interval length as D, and an interval length between the charge hole and a second free surface G2 as E $$W=D=E=P \tag{1aa}$$

said fracture rock volume V being $$V=D\times E\times M \tag{1bb}$$

since sin α=1, thus $$\sin^3 \alpha=1 \tag{1c}$$

$$V=P^2M \sin^3 \alpha \tag{1}$$

may be obtained by substituting (1aa) and (1c) into (1bb).

4. A method for setting fracture rock volume to be blasted with a bar-like charge system according to claim 1, wherein in a blasting operation using a bar-like charge system for one free surface, when α<90°, the line of least resistance is defined as W, the fracture radius or interval length as D, and $$W=D<P,$$

therefore, $$W=D=P \sin \alpha \tag{1aaa}$$

said fracture rock volume V being $$V=D\times D\times H \tag{1bbb}$$

where H defines a vertical height of the hole length M from the first free surface G1, and H<M, thus:

$$H=M \sin \alpha \tag{1d}$$

therefore, $$V=P \sin \alpha\times P \sin \alpha\times M \sin \alpha=P^2M \sin^3 \alpha \tag{1}$$

may be obtained by substituting equations (1aaa) and (1d) into equation (1bbb).

5. A method for setting fracture rock volume to be blasted with a bar-like charge according to claim 1, wherein in a blasting operation using a bar-like charge system for two free surfaces, when α<90°, the line of least resistance is defined as W, the fracture radius or interval length as D, and an interval length between the charge hole and the second free surface G2 as E, and $$W=D<P=E$$

therefore, $$W=D=P \sin \alpha=E \sin \alpha \tag{1aaaa}$$

said fracture rock volume V being $$V=D\times E\times H \tag{1bbbb}$$

where H defines the vertical height of the hole length M from the first free surface G1, and H<M, thus:

$$H=M \sin \alpha \tag{1d}$$

therefore, $$V=P \sin \alpha\times E \sin \alpha\times M \sin \alpha=P^2M \sin^3 \alpha \tag{1}$$

may be obtained by substituting equations (1aaaa) and (1d) into equation (1bbbb).

6. A method for setting a charge amount for a bar-like charge system according to claim 1, wherein the charge amount L is determined as $$L=\frac{\left\{-\frac{\pi}{4}d^2A+\sqrt{\left(\frac{\pi}{4}d^2A\right)^2+\pi d^2AcN^2\sin^3\alpha}\right\}^2}{4cM\sin^3\alpha} \tag{6}$$

by substituting equation (5) set forth in claim 1 into equation L=cV, which is modified from equation (3), where the blasting coefficient c should be within the range of:

c=0.0002–0.0005.

7. A method for setting a charge amount for a bar-like charge system according to claim 1, wherein the charge length N=M−P is derived as $$N=\frac{4cV}{\pi d^a A} \tag{7}$$

from equation (2) set forth in claim 1 and from equation (3) modified as:

$$L=cV=\frac{\pi}{4}d^2(M-P)A$$

where the blasting coefficient c should be within the range of:

c=0.0002–0.0005.

8. A method for setting a filler length for a bar-like charge system according to claim 7, wherein equation (7) according to claim 7 is substituted into the filler length P since P=M−N to obtain:

$$P=M-\frac{4cV}{\pi d^2A} \tag{8}$$

where the blasting coefficient c should be within the range of:

c=0.0002–0.0005.

9. A method for setting a fracture radius or interval length for a bar-like charge system according to claim 8, wherein when the fracture radius or interval length D is set to be equal to the filler length P, i.e., P=E, the fracture radius or interval length D is determined as:

$$D=M-\frac{4cV}{\pi d^2A} \tag{9}$$

instead of equation (8) set forth in claim 8, where the blasting coefficient c should be within the range of:

c=0.0002–0.0005.

10. A method for setting the interval between the charge hole and the second free surface G2 for a bar-like charge system according to claim 8, wherein when the interval length E between the charge hole and the second free surface G2 is set to be equal to the filler length P, i.e., E=P, in a blasting operation using a bar-like charge system in two free surfaces, the interval length E is determined as:

$$E = M - \frac{4cV}{\pi d^2 A} \tag{10}$$

instead of the equation (8) set forth in claim 8, where the blasting coefficient c should be within the range of:

c=0.0002–0.0005.

11. A method for setting charge hole length for a bar-like charge system according to claim 8, wherein equation (8) set forth in claim 8 is modified so as to determine the charge hole length M as:

$$M = P + \frac{4cV}{\pi d^2 A} \tag{11}$$

where the blasting coefficient c should be within the range of:

c=0.0002–0.0005.

12. A method for setting the charge hole length of a bar-like charge system according to claim 11, wherein when the fracture radius or interval length D is set to be equal to the filler length P, i.e., D=P, the charge hole length M is determined as:

$$M = D + \frac{4cV}{\pi d^2 A} \tag{12}$$

instead of equation (11) set forth in claim 11, where the blasting coefficient c should be within the range of:

c=0.0002–0.0005.

13. A method for setting the charge hole length of a bar-like charge system according to claim 11, wherein when the interval length E between the charge hole and the second free surface G2 is set to be equal to the filler length P, i.e., E=P, in the blasting operation using a bar-like charge system in two free surfaces, the charge hole length M is determined as $$M = E + \frac{4cV}{\pi d^2 A} \tag{13}$$

instead of the equation (11) set forth in claim 11, where the blasting coefficient c should be within the range of:

c=0.0002–0.0005.

14. A method for the setting the line of least resistance of a bar-like charge system according to claim 8, wherein the line of least resistance W is determined as:

$$W = \left\{M - \frac{4cV}{\pi d^2 A}\right\}\sin\alpha \tag{14}$$

based on the relationship W=P sin α, instead of using equation (8) set forth in claim 8, where the blasting coefficient c should be within the range of:

c=0.0002–0.0005.

15. A method for setting the fracture radius or interval length for a bar-like charge system according to claim 14, wherein when the fracture radius or interval length D is set to be equal to the line of least resistance W, i.e., D=W, the fracture radius or interval length D is determined as:

$$D = \left\{M - \frac{4cV}{\pi d^2 A}\right\}\sin\alpha \tag{15}$$

based on D=P sin α, instead of using equation (14) set forth in claim 14, where the blasting coefficient c should be within the range of:

c=0.0002–0.0005.

16. A method for setting the interval length between the charge hole and the second free surface G2 for a bar-like charge system according to claim 14, wherein when the interval length E between the charge hole and the second free surface G2 is set to be equal to the line of least resistance W, i.e., E=W, the interval length E is determined as:

$$E = \left\{M - \frac{4cV}{\lambda d^2 A}\right\}\sin\alpha \tag{16}$$

based on the relationship E=P sin α, instead of using the equation (14) set forth in claim 14, where where the blasting coefficient c should be within the range of:

c=0.0002–0.0005.

17. A method for setting the filler length for a bar-like charge system according to claim 1, wherein the filler length P is determined based on equation (1) set forth in claim 1, as:

$$P = \sqrt{\frac{V}{M\sin^3\alpha}} \tag{17}$$

where the blasting coefficient c should be within the range of:

c=0.0002–0.0005.

18. A method for setting the fracture radius or interval length for a bar-like charge system according to claim 17, wherein when the fracture radius or interval length D is set to be equal to the filler length P, i.e., D=P, the fracture radius or interval length D is determined, in place of equation (17) set forth in claim 17, as:

$$D = \sqrt{\frac{V}{M\sin^3\alpha}} \tag{18}$$

where the blasting coefficient c should be within the range of:

c=0.0002–0.0005.

19. A method for setting the interval length between the charge hole and the second free surface G2 for a bar-like charge system according to claim 17, wherein when the interval length E between the charge hole and the second free surface G2 is set to be equal to the filler length E, i.e., E=P, the interval length E is determined as:

$$E = \sqrt{\frac{V}{M\sin^3\alpha}} \tag{19}$$

where the blasting coefficient c should be within the range of:

c=0.0002–0.0005.

20. A setting method according to any one of claims 7 to 19, wherein the fracture rock volume V is determined based on equation (1) or (5) set forth in claim 1.

* * * * *

UNITED STATES PATENT AND TRADEMARK OFFICE

CERTIFICATE OF CORRECTION

PATENT NO. : 6,155,172
DATED : December 5, 2000
INVENTOR(S) : Yasuji Nakajima

It is certified that error appears in the above-identified patent and that said Letters Patent is hereby corrected as shown below:

Column 9,
Line 27, "usging" should read -- using --
Line 28, "H = H sin α" should read -- H = M sin α --

Column 10,
Line 28 " " should read -- or --

Column 14,
Lines 1-5

$$L = \frac{\left\{-\frac{\pi}{4}d^2A + \sqrt{\left(\frac{\pi}{4}d^2A\right)^2 + \pi d^2 AcM^2 \sin^3\alpha}\right\}^2}{4cM \sin^3\alpha}$$

should read $$L = \frac{\left\{-\frac{\pi}{4}d^2A + \sqrt{\left(\frac{\pi}{4}d^2A\right)^2 + \pi d^2 AcM^2 \sin^3\alpha}\right\}^2}{4cM \sin^3\alpha}$$

Column 16,
Line 22 $E = \left\{M - \frac{4cV}{\lambda d^2 A}\right\}\sin\alpha$ should read -- $E = \left\{M - \frac{4cV}{\pi d^2 A}\right\}\sin\alpha$ --

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*